United States Patent [19]

Glück

[11] 4,404,023

[45] Sep. 13, 1983

[54] PROCESS FOR THE PRODUCTION OF A METAL OR METAL ALLOY POWDER

[75] Inventor: Wolfgang Glück, Neuhaus, Fed. Rep. of Germany

[73] Assignee: Eckart-Werke Standard Bronzepulver-Werke Carl Eckart, Furth, Fed. Rep. of Germany

[21] Appl. No.: 363,572

[22] Filed: Mar. 30, 1982

[30] Foreign Application Priority Data

Apr. 7, 1981 [DE] Fed. Rep. of Germany ..... 3113886

[51] Int. Cl.[3] ..... B22F 9/04

[52] U.S. Cl. ..... 75/0.5 R; 75/0.5 B; 148/11.5 P; 241/26; 241/27

[58] Field of Search ..... 75/0.5 B, 0.5 R, 0.5 BA; 241/26, 27; 148/11.5 P

[56] References Cited

U.S. PATENT DOCUMENTS

| | | | |
|---|---|---|---|
| 3,765,866 | 10/1973 | Nayar | 75/0.5 B |
| 3,787,200 | 1/1974 | Finlay et al. | 75/0.5 B |
| 3,832,156 | 8/1974 | Wilson et al. | 75/0.5 B |
| 3,837,930 | 9/1974 | Cairns et al. | 148/11.5 P |

*Primary Examiner*—W. Stallard

[57] ABSTRACT

A process for the production of a metal or metal alloy powder with flake-shaped particles comprises mechanically crushing a ductile starting material. A foreign substance which forms a separate phase between the crystallites of the starting material is added thereto to facilitate crushing the starting material, while retaining the original workability thereof.

12 Claims, 1 Drawing Figure

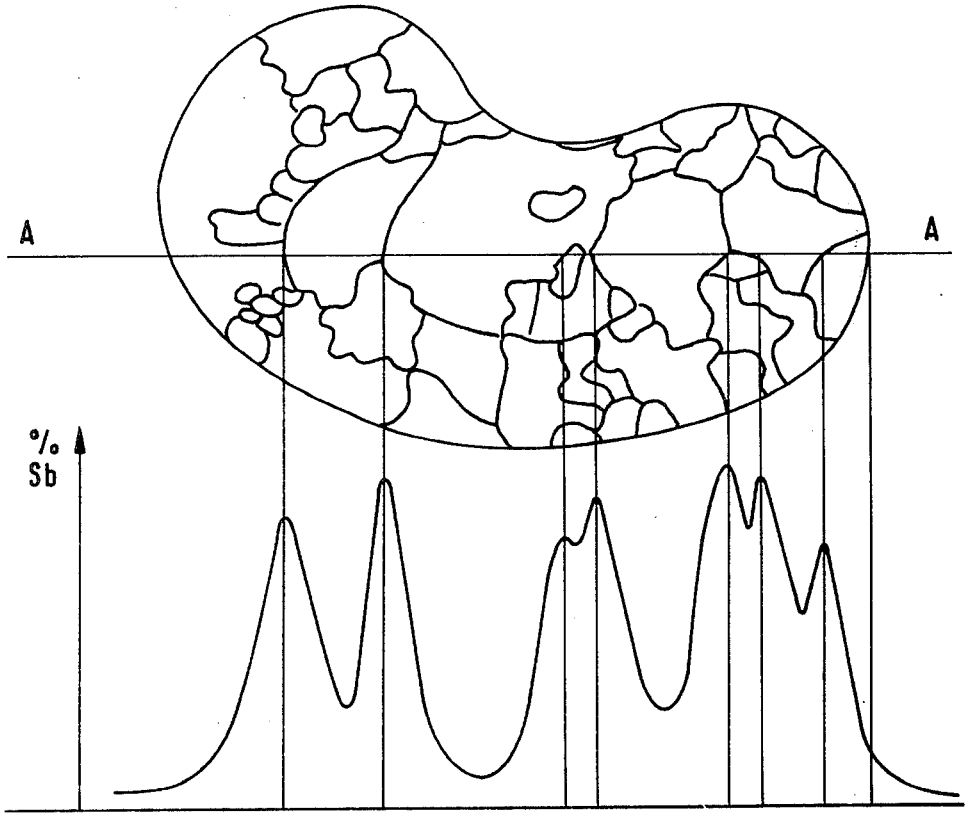
A
A
%
Sb

PROCESS FOR THE PRODUCTION OF A METAL OR METAL ALLOY POWDER

BACKGROUND OF THE INVENTION

The present invention is concerned with a process for the production of a metal or metal alloy powder wherein the particles of powder are of a flake-like nature.

Metal or metal alloy powders with particles of flake-like nature are widely used in coating materials, for example bodywork paints and lacquers, because of their pronounced metallic shine. Such a powder may be produced by mechanically crushing or grinding a ductile starting material, and the operation of forming the flakes may be effected simultaneously with the grinding or crushing operation, or as a separate mechanical process. A certain degree of ductility of the starting material is important in order for it to be capable of being worked into the form of flakes. Accordingly, the line of development followed in this connection was and is directed to improving the capability of the starting material, for being formed into flakes.

However, the ductile properties of the starting material used for producing the metal powder give rise to difficulty in regard to the operation of crushing or grinding the starting material, which is generally in the form of a grit, or granular material. Although it has been observed that a proportion of lead in the metal grit causes the starting material to be harder so that it can be crushed more easily, that has the disadvantageous result that the capacity for shaping of the powder particles is severely impaired and flakes can be formed only to a very limited degree. It is for that reason that in the past the problems involved in crushing the ductile starting material, and thus the higher costs involved in overcoming the particular problems encountered in the crushing or grinding process were accepted, because of the desirability of the starting materia being easier to shape into flakes. It was thought that it was not possible to solve the problem of enhancing the crushability of the starting material, while at the same time retaining the ductility of the starting material, by using suitable additives in the starting material.

SUMMARY OF THE INVENTION

An object of the present invention is to provide a starting material for a process for the production of a metal or metal alloy powder with flake-like particles, which has good ductility and good crushing capability.

A further object of the present invention is to provide a process for the production of a metal or metal alloy powder with flake particles, which uses a starting material enjoying both good ductility and good grinding capability.

Still another object of the present invention is the production of a metal or metal alloy powder wherein the desired combination of good shaping capability and good grinding capability of the starting material is achieved by simple means.

These and other objects are attained by a process for the production of a metal or metal alloy powder having flake-like particles, which comprises mechanically crushing or grinding a ductile starting material. At the same time as the crushing or grinding operation, or in a separate mechanical process, the starting material is put into the form of flakes. In order to imrove the crushing or grinding capability of the starting material, the starting material includes a foreign substance in the form of an intermediate substance, or intermediate phase, which, at the temperatures occurring in the flake-forming operation, occurs substantially only at the boundary surfaces of the crystallites of the starting material. It has surprisingly been found that incorporating the foreign substance into the metal or metal alloy structure, in the above-indicated manner, at the crystallite bounding surfaces, results in the formation of what might be referred to as predetermined rupture points or controlled fracture points, at which the coarse grains of grit are particularly easily broken up in the grinding or crushing process. Because the foreign substance is not incorporated into the crystallites of the starting material, or is incorporated only to a negligible extent, the shaping capability of the broken fragments or pieces produced in the crushing or grinding operation is not substantially impaired and may even be totally unaffected.

The requirement, as referred to above, that the foreign substance is to occur in the grains of the starting material substantially only in the form of an intermediate substance, that is to say, as a separate or intermediate phase, and is not to be incorporated for example in the crystallites or the lattice structures thereof, virtually predetermines the foreign substance to be used in any given case, that is to say, for a given starting material, and also the upper limit in regard to the proportion of foreign substance in the starting material. The nature of the foreign substance to be used in any given case can be readily determined by a few simple tests. As regards the proportion of foreign substance in the starting material, if that proportion exceeds the upper limit, to which further reference will be made below, the powder particles per se would become more brittle or friable, so that the capability for shaping of the material would be severely impaired. In this respect, it should be appreciated that the capability of the foreign substance for occurring in the form of an intermediate substance or phase must be retained at the temperatures (generally from 60° to 100° C.) which occur in the course of the operation of forming the starting material into flakes, so that the foreign substance does not become incorporated into the crystallites of the starting material. However, the proportion of foreign substance in the starting material is also subjected to an upper limit by virtue of the desirability or need for retaining the character of the metal particles in respect of colour. The lower limit in regard to the proportion of foreign substance in the starting material is set in consideration of the aim of the present invention, namely improving the crushing or grinding capability of the starting material.

The term foreign substance in connection with the present invention also means a mixture of various substances. The foreign substances involved may be metals, metal alloys, metalloids and compounds thereof. In accordance with the present invention, the foreign substances may be formed only when making the starting material from the metal or metals thereof and an additive substance, and may represent for example an intermetallic compounds.

In accordance with a feature of the invention, when the starting material used is copper or a copper-zinc alloy, bismuth and antimony constitute foreign substances which are suitable for the purposes of the present invention. In accordance with another feature, the proportion of foreign substance in the starting material is generally from 0.1 to 5% and preferably from 1 to 2%.

The procedure for producing the starting material used in accordance with the principles of this invention is such that the above-described structure is formed, that is to say, the foreign substance is deposited in the form of an intermediate substance or phase, at the crystallite boundary surfaces. This may be achieved by suitably controlling the cooling process in the operation of passing the starting material melt which contains the foreign substance through a nozzle, taking into account the constitutional diagram applicable to the system in question (starting material/foreign substance); alternatively, this effect may also be achieved by a subsequent heat treatment such as annealing.

Further objects, features and advantages of the present invention will be apparent from the following description of Examples illustrating the principles of the present invention.

EXAMPLE 1

An amount of 2 kg of brass grit or granular material produced as by passing through a nozzle was crushed or ground in a laboratory ball mill. The composition of the alloy was 84% Cu and 16% Zn. The brass in granular form was restricted by sieving to a particle size of from 63 to 200μ. The grinding test was then repeated under working conditions which were otherwise the same, except that the brass used contained 1.5% Sb as an intermetallic phase. The fine component which was produced in the grinding operation, with a particle size of less than 63μ, was about 5% in the case of the first test without Sb, and about 68% in the test using the Sb additive substance. No marked differences were found between the two crushed materials produced, in regard to the operation of putting the material into the form of flake-like particles.

EXAMPLE 2

An industrial ball mill was used to grind brass grit produced as by passing through a nozzle in a continuous operation. The composition of the alloy was 84% Cu and 16% Zn. Brass grit was then crushed or ground under the same operating conditions, except that the brass included the foreign substance in accordance with this invention, by virtue of the addition of 1.2% Bi to the melt used for producing the granular brass starting material. The hourly output of the ball mill could be increased by about 9%, with the material produced being of the same quality.

EXAMPLE 3

The test described above in Example 2 was repeated except that 3% As had been added to the melt, instead of the Bi. With the material produced being of the same quality, the hourly output of the mill could be increased by about 15%.

EXAMPLE 4

The test described above in Example 2 was repeated, except that 0.8% Sb was added to the melt instead of Bi. With the material produced being of substantially the same quality, the hourly output of the machine could be increased by about 20%.

EXAMPLE 5

Copper grit or granular copper material produced by passing through a nozzle was continuously crushed in an industrial ball mill. The crushing operation was then performed using copper starting material to which 0.5% Bi was added in making the melt used for preparing the starting material. Under the same operating conditions, and with the material produced being of the same quality, the hourly output of the ball mill could be increased by about 30%.

EXAMPLE 6

Aluminium grit starting material was ground in a batchwise process in a ball mill in the presence of turpentine substitute. The grinding operation was then carried out using aluminium starting material to which 1% Cer had been added in production in the melt. With the operating conditions being otherwise the same, and with the material produced being of the same quality, the output of the ball mill could be increased by about 14%.

EXAMPLE 7

The test described above in Example 6 was repeated, except that 1.1% Sb was added to the aluminium melt instead of Cer. With the operating conditions being otherwise the same, and with the material produced being of the same quality, the output of the mill could be increased by about 20%.

Reference will now be made to the accompanying drawing showing the structure of a (metal) grain produced in accordance with the process of the present invention, by means of a polished section which has been subsequently drawn in in order to clarify the structure, and a graph diagram relting to a section taken on line 4—4, for diagrammatically illustrating the distribution of the foreign substance (Sb) which is incorporated into the grain, along the section surface. The peaks of the curve illustrated, that is to say, the points having the highest levels of foreign substance concentration, occur between the individual crystallites because in accordance with the teaching and principles of the present invention, when the melt sets, the foreign substance is increased in concentration at the crystallite boundary surfaces.

It will be appreciated that the invention has been described hereinbefore by way of example and illustration and that other modifications and alterations may be made therein without thereby departing from the scope of the invention.

What is claimed is:

1. A process for the production of a metal powder having flake-like particles comprising mechanically grinding a ductile starting material and putting the material into flake form, wherein the starting material includes a foreign substance as an intermediate substance which at the temperatures occurring in the flake-forming process occurs substantially only at the boundary surfaces of the crystallites of the starting material, in order thereby to improve the crushability of the starting material.

2. A process as set forth in claim 1 wherein said starting material is a metal alloy, thereby to produce a metal alloy powder.

3. A process as set forth in claim 1 wherein the flake-forming operation is effected at the same time as the crushing operation.

4. A process as set forth in claim 1 wherein the flake-forming operation is effected as a separate mechanical operation.

5. A process as set forth in claim 1 wherein the proportion of foreign substance in the starting material is from 0.1 to 5%.

6. A process as set forth in claim 1 wherein the proportion of foreign substance in the starting material is from 1 to 2%.

7. A process as set forth in claim 1 wherein said foreign substance comprises bismuth.

8. A process as set forth in claim 1 wherein said foreign substance comprises antimony.

9. A process as set forth in claim 1 wherein said starting material comprises brass and said foreign substance comprises bismuth.

10. A process as set forth in claim 1 wherein said starting material comprises brass and said foreign substance comprises antimony.

11. A process as set forth in claim 1, wherein said starting material comprises copper and said foreign substance comprises bismuth.

12. A process as set forth in claim 1 wherein said starting material comprises aluminium and said foreign substance comprises antimony.

* * * * *